US009174826B1

(12) United States Patent
Nieves et al.

(10) Patent No.: US 9,174,826 B1
(45) Date of Patent: Nov. 3, 2015

(54) WALL PANEL

(71) Applicant: ELECLIP INTERIOR SYSTEMS, LLC, Miami, FL (US)

(72) Inventors: Rolando M Nieves, Miami, FL (US); Bill K Swenson, Miami, FL (US); David F Estrada, Miami, FL (US); Alejandro Guerra, Miami, FL (US); Dariesky Linares, Miami, FL (US)

( * ) Notice: Subject to any disclaimer, the term of this patent is extended or adjusted under 35 U.S.C. 154(b) by 0 days.

(21) Appl. No.: 14/482,788

(22) Filed: Sep. 10, 2014

(51) Int. Cl.
*E04B 2/72* (2006.01)
*B66B 11/02* (2006.01)
*E04B 2/74* (2006.01)

(52) U.S. Cl.
CPC ..... *B66B 11/0253* (2013.01); *E04B 2/7407* (2013.01); *E04B 2002/7462* (2013.01); *E04B 2002/7464* (2013.01); *Y10T 24/44026* (2015.01); *Y10T 24/45215* (2015.01)

(58) Field of Classification Search
CPC ..... B66B 11/0253; Y10T 24/45215; Y10T 24/44026; E04B 2/7407; E04B 2002/7462; E04B 2002/7464
USPC ..... 52/474, 481.1, 482, 483.1, 489.1, 52/489.2, 506.06, 578; 248/220.31, 248/220.41, 220.43, 221.12, 224.8, 220.21; 403/329, 353
See application file for complete search history.

(56) References Cited

U.S. PATENT DOCUMENTS 1,616,095 A * 2/1927 Van Doorn et al. ..... 52/282.4
2,395,726 A * 2/1946 Del Tufo ..... 52/509
2,936,987 A * 5/1960 Carlisle et al. ..... 248/205.1
3,103,708 A * 9/1963 Pomeroy et al. ..... 52/198
3,282,004 A * 11/1966 Brounn ..... 52/269
3,544,951 A * 12/1970 Roberts ..... 439/358
4,047,349 A * 9/1977 Aguilar, Jr. ..... 52/551
4,352,478 A * 10/1982 Loew ..... 248/222.11
4,394,809 A * 7/1983 Sherwood et al. ..... 52/512
4,601,247 A * 7/1986 Welch et al. ..... 108/152
4,660,339 A * 4/1987 Paz ..... 52/238.1
4,875,552 A * 10/1989 Smith et al. ..... 187/401
5,031,367 A * 7/1991 Butzen ..... 52/60
5,101,540 A * 4/1992 Roof et al. ..... 24/458
5,177,917 A * 1/1993 del Castillo Von Haucke ..... 52/220.7
5,255,887 A * 10/1993 Schumacher et al. ..... 248/676
5,291,843 A * 3/1994 Hori ..... 112/103
5,526,553 A * 6/1996 Klein ..... 24/295
5,556,079 A * 9/1996 West ..... 256/22
5,598,611 A * 2/1997 Yamada et al. ..... 24/581.1
5,642,593 A * 7/1997 Shieh ..... 52/239
5,716,161 A * 2/1998 Moore et al. ..... 403/326
6,164,029 A * 12/2000 Lee ..... 52/386
6,378,828 B1 * 4/2002 Valiulis et al. ..... 248/231.81
6,430,883 B1 * 8/2002 Paz et al. ..... 52/235
6,805,185 B2 * 10/2004 Gravel et al. ..... 160/135

(Continued)

*Primary Examiner* — Brent W Herring

(74) *Attorney, Agent, or Firm* — Christopher J. Vandam, PA; Chris Vandam

(57) ABSTRACT

A wall panel system that is adapted to be attached over an existing vertical substrate, such as a wall or stripped interior of an elevator cab. Panel assemblies, base assemblies and frieze assemblies are provided. There are several versions of hangers that are first attached to the vertical substrate onto which the panels, base and frieze are hung. The back of the panel assemblies have a series of apertures on each vertical edge that engage into the hangers that allow for some lateral movement of the panels to achieve uniform reveal gaps between multiple panels in a particular installation.

5 Claims, 3 Drawing Sheets

(56) References Cited

U.S. PATENT DOCUMENTS

| | | | | |
|---|---|---|---|---|
| 6,951,087 | B2 * | 10/2005 | Weurman | 52/489.2 |
| 7,805,815 | B2 * | 10/2010 | Babian et al. | 24/295 |
| 8,316,599 | B2 * | 11/2012 | Griffiths | 52/235 |
| 8,468,767 | B1 * | 6/2013 | McBride | 52/586.2 |
| 2002/0005464 | A1 * | 1/2002 | Miura | 248/231.9 |
| 2010/0229484 | A1 * | 9/2010 | Carolan et al. | 52/302.1 |
| 2012/0192518 | A1 * | 8/2012 | Delforte | 52/506.05 |
| 2012/0274094 | A1 * | 11/2012 | Mazur et al. | 296/146.7 |

* cited by examiner

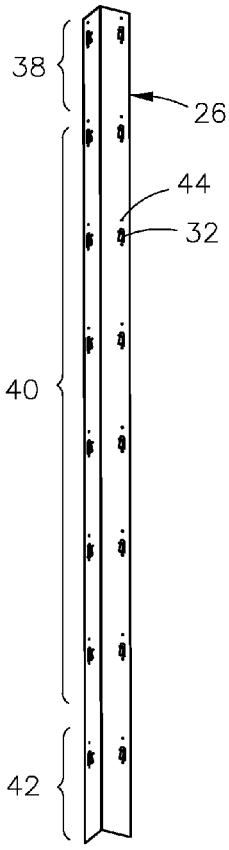
Fig. 2
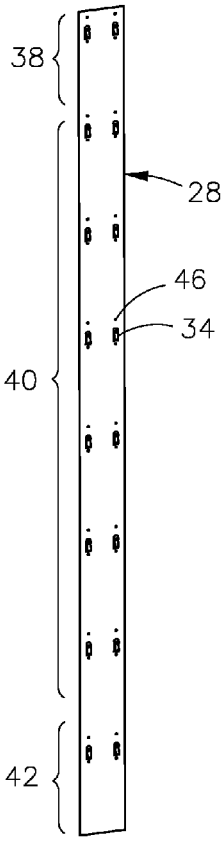
Fig. 3
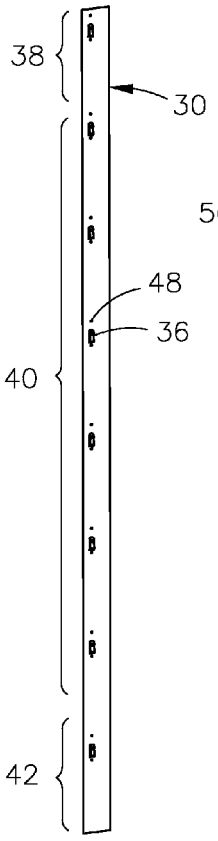
Fig. 4
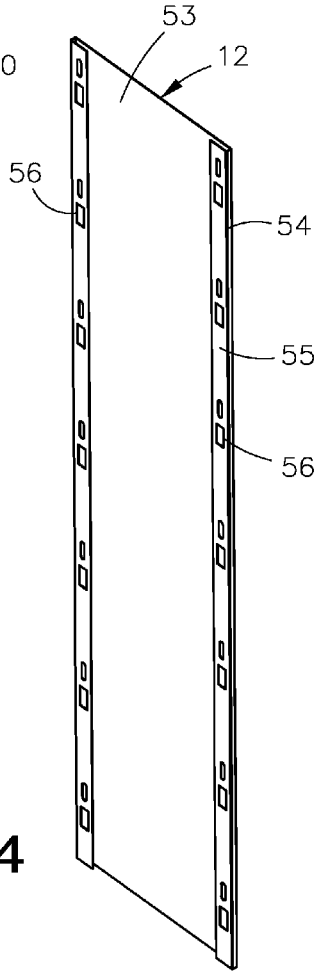
Fig. 6
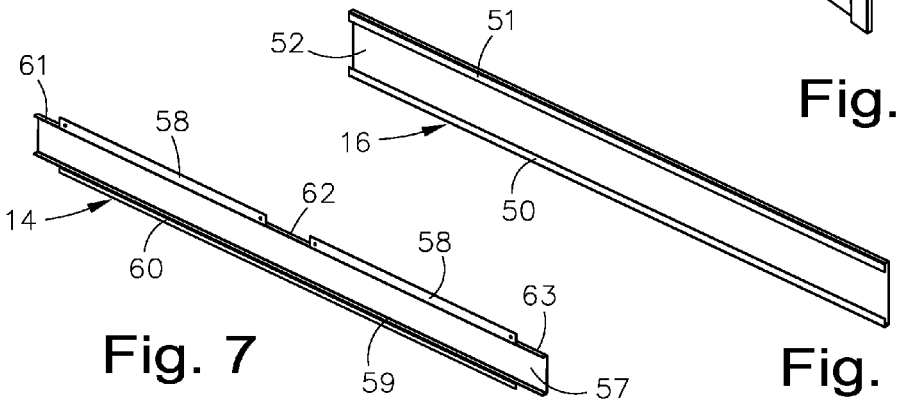
Fig. 5
Fig. 7

WALL PANEL

BACKGROUND OF THE INVENTION

1. Field of the Invention

The present invention relates to wall panels, and more particularly, to adjustable spacing and mounting of vertical wall panels.

2. Description of the Related Art

Several designs for wall panels have been designed in the past. None of them, however, includes a simple system of panels, brackets and other parts that allow the system to be fabricated off site and then fine-tuned during installation.

Prior art designs include rack systems that adhere or screw panels to walls. These designs fail in allowing for a system to be designed and made off site and then installed with a degree of lateral adjustability. These prior art designs often leave a results that is less than perfect, particularly with the spacing between panels and overall fit. Some solutions require laborious shimming to adjust the reveal between panels.

Other prior art panel systems are difficult to install and may require highly skilled installers to fit the panels in place. This can cause labor costs to increase as well as delays in installation and therefore final use of the space outfitted with the panels.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a wall panel system that is efficient to design, manufacture and install while keeping costs under control.

It is another object of this invention to provide a wall panel system that can be fine-tuned on the job site to adapt the system to variations and irregularities in substrates.

It is still another object of the present invention to provide an adaptable and attractive system for new construction or retrofitting of elevator cabin interiors.

Another object of the invention is to provide a light weight complete system that can be retrofit into existing cabs or can be incorporated into the design of new installations.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 2 shows a perspective view of an example of a corner bracket assembly.

FIG. 3 illustrates a perspective view of a version of a panel joining bracket assembly.

FIG. 4 is a perspective view representation of a variant of an end panel bracket assembly.

FIG. 5 is a rear side perspective view of an example of a frieze panel component of a panel system.

FIG. 6 is a rear side perspective view of a possible panel configuration.

FIG. 7 is a rear side perspective view of a version of a base panel that is a part of a panel system.

DETAILED DESCRIPTION OF THE PREFERRED EMBODIMENT

Figure 1:
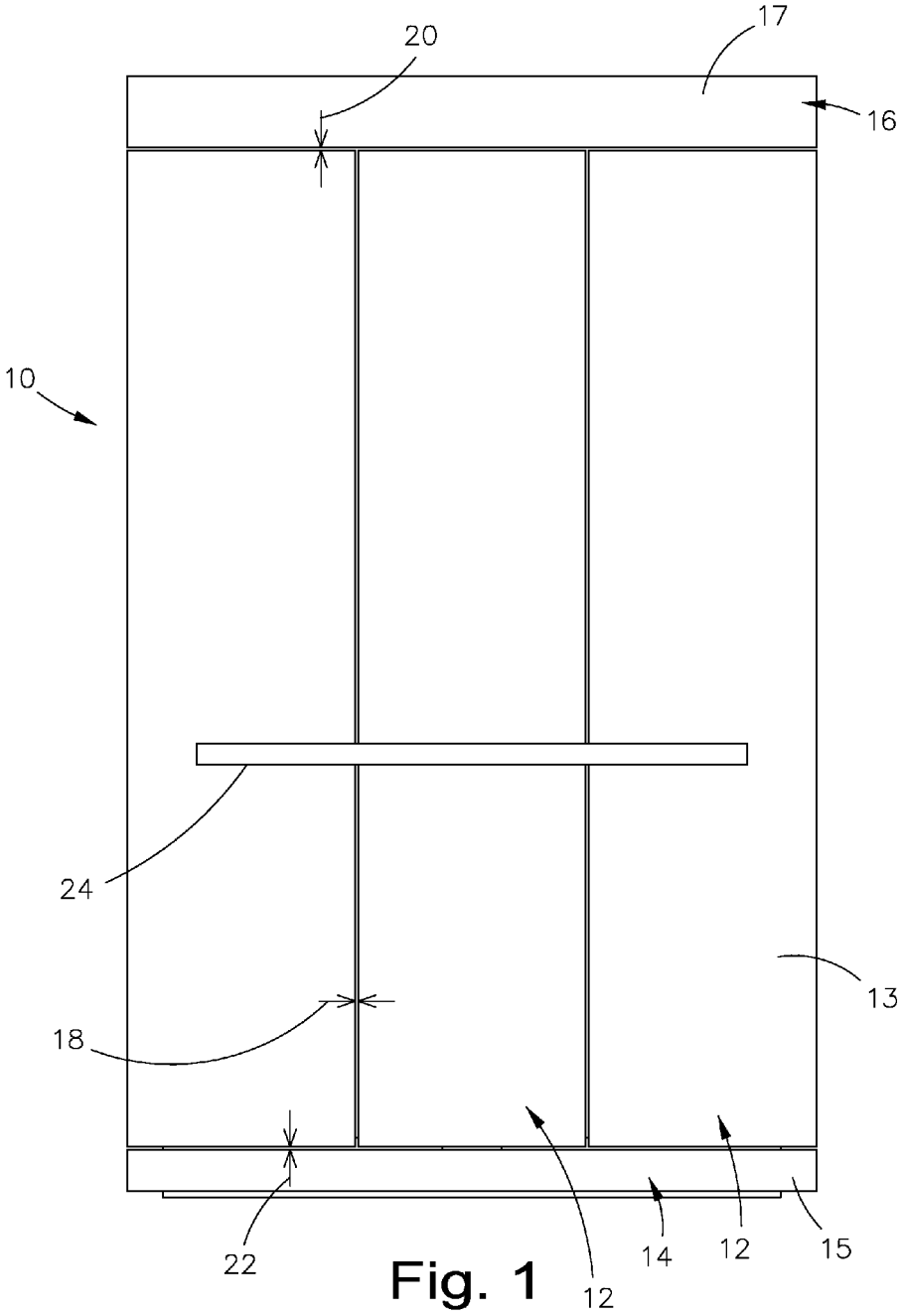
FIG. 1 represents an elevation view of a version of an interior of an elevator including the wall panels and other accessory components.

Referring now to the drawings, where the present invention is generally referred to with numeral 10, it can be observed that it basically includes a panel assembly 12, a base assembly 14 and a frieze assembly 16 as well as an assortment of some of a corner assembly 26, a joint assembly 28 and/or an end assembly 30.

For contextual purposes, also shown in FIG. 1 are a horizontal reveal 18, a vertical reveal 20, a vertical reveal 22 and a handrail 24. Each of the panel assemblies 12 have a face 13 and a back 53. The base assembly 13 has a face 15 and a back 57. The frieze assembly 16 has a face 17 and a back 52 side.

FIG. 1 shows generally an example of a wall with a version of the present device as might be employed in a typical installation inside the cab of an elevator. A base assembly 14 makes up a lowest section and spans the width of several panel assemblies 12. Although the base assembly 14 provides for a stylish look preferred by many and us used to keep the panel assemblies 12 level. The base assembly 14 can also guide the reveals and can act to lock the panel assemblies 12 into place.

A frieze assembly 16 is typical of an example of an upper panel that completes a modern look. The frieze assembly 16 also acts to secure the panel assemblies 12 in place by preventing the panel assemblies 12 from being lifted and removed by unauthorized persons and for an improved safety factor.

An optional handrail 24 is provided for safety as well. This handrail 24 is particularly useful in elevator applications or other hazard prone areas like bathrooms. The handrail 24 at one end can be attached to the face 13 of one panel assembly 12 and on the other end is connected to another panel assembly 12. An escutcheon (not shown in the drawings) may also be used at the connection points to the panel assembly 12 to hide the mounting hardware and provide a polished look. The connection points of the handrail 24 may include embedded threaded fasteners to secure the handrail 24 to the panel assemblies 12.

A noted feature of the present design (in any of the various embodiments) stems from the system being comprised of multiple panel assemblies 12, a base assembly 14 and a frieze assembly 16 each juxtaposed in an aesthetically pleasing configuration. To get a pleasing look, any adjacent panel assemblies 12 should have a consistent reveal 18 and/or joints between panels. The system lends itself to many configurations, of which these are mere examples.

Similarly, the vertical reveal 20 between the tops of the panel assemblies 12 and the bottom of the frieze assembly 16 is preferably uniform from end to end. The vertical reveal 22 between the top of the base panel assembly 14 and the bottom edges of the panel assemblies is preferably consistent from one end to the other for a visually correct fitted appearance.

FIGS. 2, 3 and 4 show examples of mounting brackets described as a corner assembly 26, a joint assembly 28 and an end assembly 30, respectively. Each of these examples are similar in that the mounting bracket can be affixed to a wall and then a panel assembly 12 can be affixed to the mounting bracket.

Each of the corner assembly 26, joint assembly 28 and end assembly 30 has an upper frieze zone 38, a bottom base zone 42 and an intervening panel zone 40. A frieze assembly 16 attaches to a corresponding bracket in a frieze zone 38. A panel assembly 12 attached to corresponding bracket in a panel zone 40. A base assembly 14 is attached to a corresponding bracket in a base zone 42.

The corner assembly 26 in FIG. 2 is specifically adapted to be used to support two adjacent panel assemblies 12 that are oriented at a right angle to each other. It should be appreciated that FIG. 2 shows an "inside" corner assembly because the clips 32 protrude from the inside face. An "outside" corner assembly would have a similar ninety degree configuration but the clips 32 would be protruding on the opposite surface of the corner assembly 26.

Holes 44 are located at preselected places on the corner assembly 26 so that it can be affixed to the wall structure onto which the panels are to be mounted. Typically screws, rivets, double sided VHB and/or other commonly available fasteners are used to secure the corner assembly 26 to the wall structure onto which it is mounted.

It should be appreciated that each panel assembly 12 will have a hanger at each the left and right side. Depending on the adjacent surface and other design considerations, a combination of the hangers in FIG. 2, 3 or 4 may be used in combination. The hangers used on either side of a panel assembly 12 do not need to match each other.

FIG. 3 includes a joint assembly 28 hanger that is used to hang the edges of two adjacent panel assemblies 12 where the panel assemblies 12 are generally coplanar or side by side. As seen in the drawings there are two parallel rows of clips 34 along the length of the joint assembly 28 with intervening spaced mounting holes 46.

The mounting holes 46 are used to attach the joint assembly 28 to the existing structure, for example, the raw, unfinished interior of an elevator cab. The panel assemblies 12 are then attached to the joint assembly 28 by hanging the panel assembly 12 onto the clips 34. A frieze assembly 16 and a base assembly 14 are also affixed to the joint assembly 28 at the frieze zone 38 and the base zone 42, respectively.

The order that the panel assembly 12, base assembly 14 and frieze assembly 16 are installed can vary from installation to installation. Generally, the hangers: the corner assembly 26, joint assembly 28 and end assembly 30 are carefully laid out according to the engineer's specifications and are secured to the walls. Then the base assembly 14 is secured to the hangers. Then the panel assemblies 12 are hung and properly spaced. The frieze assembly 16 is then affixed to the hangers above the panel assemblies 12 to secure and prevent the panel assemblies 12 from being moved or removed relative to the wall.

FIG. 4 is an example of how an end assembly 30 may be configured. The end assembly 30 is typically used at the end of a run of panel assemblies 12. The corner assembly 26 and joint assembly 28 both are used to support the edges of two separate and adjacent panel assemblies 12. In contrast, an end assembly 30 holds only one side of one panel assembly 12.

The end assembly 30 has a series of clips 36 spaced along the length of the end assembly 30 similar to the corner assembly 26 and joint assembly 28. Also like the other hangers, the end assembly 30 has a series of holes 48 along its length to provide a means to hang the end assembly 30 securely to a wall substrate.

The holes 44, 46 and 48 are shown as examples of how any of the hangers could be secured to a wall or other similar substrate. These are mere examples of but one effective means. The hangers shown generally in figures two, three and four could be upheld by welding, adhesives, rivets, clips or other known type or means to safely secure rigid objects to one another.

Figures five, six and seven show the back sides of the frieze assembly 16, panel assembly 12 and base assembly 14, respectively, in more detail as is required for a thorough understanding to further include a standoff 50, a hanger 51, a frieze back 52, a panel back 53, a side 54, a rail 55, an aperture 56, a base back 57, a hanger 58, a standoff 59, a flange 60, a gap 61, a gap 62 and a gap 63.

The frieze assembly 16 is shown individually in FIG. 5 where the frieze back 52 is seen. When installing a wall panel system the hanger 51 is placed over at least two corresponding clips, for example any of the clip 32 on a corner assembly 26, a clip 34 on the joint assembly 28 or the clip 36 on the end assembly. Each of the clips used for the frieze hanger 51 would likely be in the frieze zone 38. Depending on the design for the specific application the frieze assembly 16 could be used with other designated clips or zones.

When the frieze assembly 16 has the hanger 51 on the selected clips the standoff 50 keeps the face 17 of the frieze assembly 16 substantially vertical and secure. If needed, the nature of the hanger 51 allows some left and right movement to ensure that the frieze assembly 16 is lined up with the panel or panels over which it is mounted.

FIG. 6 shows an example of a panel back 52 of a panel assembly 12. On either side of the panel back 52 is a rail 55 that is generally parallel to the panel back 53. The rail 55 should be held off of the panel back 53 by a short distance by the side 54. The side 54 is generally no more than a couple of inches but not less than to allow for sufficient engagement of a clip (for example any of the clips 32, 34 or 36) into any of the apertures 56 on the rail 55.

Each rail 55 on the left and right back of the panel assemblies 12 has a series of apertures 56 in a substantially vertical configuration. The apertures 56 are spaced about equally on center as are the clips 32, 24 or 36 in the panel zone 40 on any of the corner assembly 26, joint assembly 28 or end assembly 30. These clips are adapted to engage in predetermined apertures 56.

Each rail 54 on the panel assembly 12 is often designed to align with the respective corner assembly 26, joint assembly 28 or end assembly 30. The number of apertures 56 present on a given rail 55 is commensurate with the number of clips so that each aperture 55 is mated to a particular clip 32, 34 or 36.

By matching each aperture 55 with a clip 32, 34 or 36 each panel is affixed to the substrate wall by means of the hangers 26, 28 or 30 at multiple points along both the left and right sides of the panel assemblies 12 for a secure installation.

FIG. 7 is a back side view of an example of a base assembly 14 where the base back 57 is visible. In a typical installation the base back 57 and therefore necessarily the face 15 are vertical. In many installations the width of the base assembly 14 will span multiple panel assemblies 12, but this is not required.

The version of the base assembly 14 is FIG. 7 has periodic gaps 61, 62 and 63 where each may be traversed by a hanger such as the corner assembly 26, joint assembly 28 or the end assembly 30. This may be required because the hangers may need to span to the floor to ensure that they can be firmly affixed to the wall substrate that may in some cases be found behind the base assembly 14.

The base assembly 14 along a top edge may have hangers 58 that are essentially flanges through which fasteners can be secured. A bottom edge of the base back 57 may have a standoff 59 and a flange 60 to help maintain the face 15 of the base assembly 14 vertical and parallel to the face 13 of the panel assembly 12.

As an alternative to the hanger 58, the upper edge of the base back 57 may have a hanger bend similar to the hanger 51 as seen in the example of the frieze assembly 16, as seen in FIG. 5 and described in more detail above.

FIGS. 8, 9, 10 and 11 are to be read in combination and are generally an example of a more detailed view of a clip and how it interacts with a similar rail 55 and aperture 56 combination and are shown to include, among other features, a clip assembly 64, a clip 65, a hole 66, a bend 67, a rail 58, a width 71 and a width 72.

Figure 8:
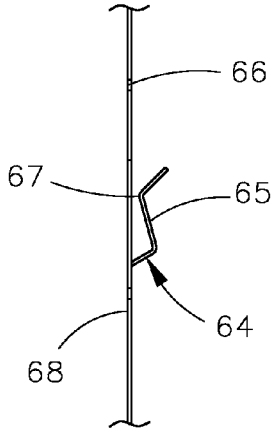
FIG. 8 is a partial side elevation view of a version of a bracket showing a possible clip configuration.
Figure 9:
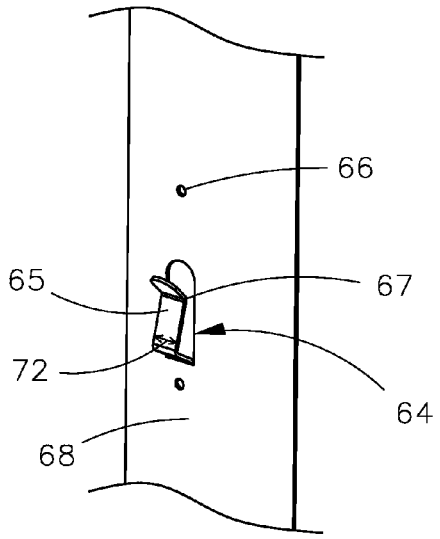
FIG. 9 is a partial perspective view of a clip configuration similar to that demonstrated in FIG. 8.

The version of a clip assembly is shown in FIGS. 8 and 9 are essentially the same version shown from different views. This style of clip assembly can be utilized for any of the hangers, such as the corner assembly 26 shown in FIG. 2, the joint assembly 28 shown in FIG. 3, the end assembly 30 shown in FIG. 4 or other type of hanger as may be needed to hang the various elements that comprise the totality of the invention as shown herein as well as reasonable variations within the scope of the inventive concept.

As noted above, the clip assembly 64 is integral to a hanger assembly. In practice, there could be several clip assemblies 64 punched and formed from the same material as from which the hangers are constructed. In significant commercial versions of the device the several hangers are made of metal and selected alloys.

The clip assembly 64 has a hole 66 nearby that is used in combination with a fastener such as a screw or rivet or commonly available means to secure the hanger assembly to the underlying structure. As an alternative to the hole 66 adhesives, brazing or welding the hanger to the underlying wall substrate structure can also be effective in certain applications as determined by the specifying engineer.

Figure 10:
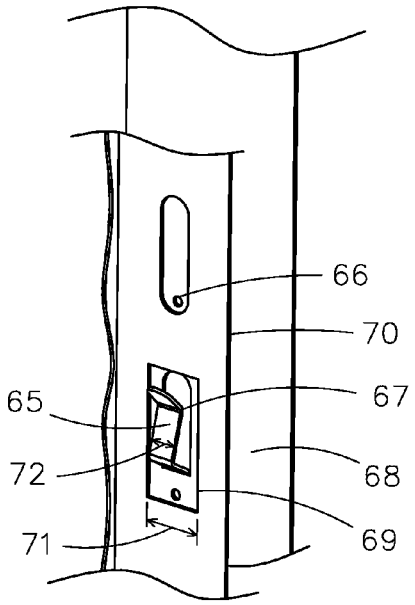
FIG. 10 is a partial perspective view of a partial bracket and a partial panel during a phase of installation.
Figure 11:
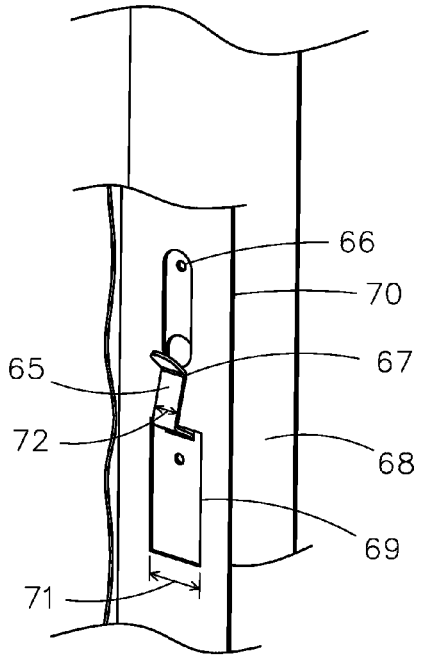
FIG. 11 is a partial perspective view of the example of the device as shown in FIG. 9 at a different phase of installation.

FIGS. 10 and 11 are essentially a cross sectional view as if the face 13 of a panel assembly 12 was removed and the rail 55 and aperture 56 remain visible. The rail 55 is similar in function to the rail 70 and the aperture 56 is similar in function to the aperture 69 shown in FIGS. 6 and 10/11 respectively. The phase of installation shown in FIGS. 10 and 11 is normally completed after the hanger rail 68 is affixed to the vertical structure onto which the entirety of the wall panel system is ultimately secured.

The clip assembly 64 has an opening on the upper side that is inserted into a corresponding aperture 69 on the rear of the panel assembly that is being hung. Practically all of the plural apertures in both the left and right rear side rails 70 of the panel assemblies will simultaneously be inserted over the equal number of clip assemblies 64 during the installation procedure.

As the rail 70 on the back of the panel assembly is placed over the clip 65 the top of the aperture 69 can temporarily rest on the bend 67. The width 72 of the clip 65 is narrower than the width 71 of the aperture 69 on the rail 70. It is the difference between width 72 and width 71 that the panel assembly can be adjusted left and right to align the spacing between adjacent panels.

Once the spacing between panel assemblies is determined acceptable by the installer when adjusting the left and right position of the panel assemblies as would be done in the configuration as shown in FIG. 10, then the panel assembly is slid down into the configuration as seen in FIG. 11. FIG. 11 shows the rail 70 that is part of the greater panel assembly forced down to fully engage the clip 65. The bend 67 of the clip then pushes and holds the mounting rail 70 against the rail 70 of the panel assembly.

An effective dimension of the width 71 can vary depending on the application. For example, the with 71 might be about a half inch to about two inches for installations ranging from elevator interior installations to office wall panel installations. The corresponding width 72 is smaller than the width 71 to allow the beneficial side to side range of adjustability that is inherent in this design.

If the width 71 is, for example, an inch, then the width 72 of the clip 65 may be about a half inch. This matched pair of width 71 and width 72 would then allow a half inch of available lateral adjustability during the installation of the panels. This is ideally sufficient to allow the installer to make the final adjustments in the reveal between panels once the panels are nearly completely hung. A visually appealing installation has consistent reveal widths between all panels in a particular room or elevator cabin.

This lateral adjustability feature by having the width 72 smaller than the width 71 can give the final installer the ability to achieve perfect panel alignment during the actual installation. This can be particularly important when the wall panel system is used to retrofit or remodel an existing condition.

For example, there are slight variations in dimensions, plumb and square of elevators that arise from imperfection in the original manufacture of the elevator cabin, because of damage, wear or earlier modifications. There could be other reasons why the elevator cabin is not perfectly plumb or square on the inside that are solved, at least aesthetically with the use of the present invention wall panel system.

This spacing between panels is sometimes referred to as a reveal because it reveals a gap between the panels. The reveal may allow to be seen the material of the hangers, such as those generally shown in FIGS. 2, 3, and 4. In some applications or installations the reveal may also allow the underlying wall or other structure onto which the wall panel system is affixed.

The faces 13, 15 and 17 may be made of a variety of materials that are visually and performance-wise appealing. The faces 13, 15 and 17 could be, by way of example, wood, metal, glass, composite, stone, painted material, plastic resin or other panel-type of look.

In a particularly effective combination, the hangers in FIGS. 2, 3 and 4 are made of steel and the panel assembly 12, base assembly 14 and frieze assembly 16 are made of sheet metal encased about a honeycomb panel to provide rigidity. The back of the panels that include the rail 55, hanger 51 and hangers 58 may be made of sheet metal as well to securely engage onto the hangers.

The particular material of any of the components described herein is not critical to the nature and spirit of the design as long as the materials are sufficient to achieve the described performance criteria. The examples of materials and dimensions are provided merely to be fully enabling and not intended to be required elements of any version of the invention unless specifically claimed.

A version of the device can be fairly described as a wall panel system comprised of a panel, a frieze and a hanger. A back side of the panel includes along both a left vertical edge and right vertical edge has a plurality of apertures spaced apart at a first period. The left vertical edge is substantially parallel to the right vertical edge. The apertures each have a predetermined horizontal first width. A back side of the frieze has a hanger along a top edge. A back side of the base has a hanger along a top edge. A front face of the panel and a front face of the frieze and a front face of the base each have a decorative finish. The hanger has a vertical edge that has a plurality of integral clips along a length of the hanger. The clips are spaced apart at about the first period. The clips each have a predetermined horizontal second width. A first hanger and a second hanger are affixed to an existing vertical structure so that the first hanger and second hanger are substantially parallel. The first and second hangers are positioned apart on the existing vertical structure so that each of the apertures are substantially centered over a corresponding clip. The width of the aperture is greater than the width of the clip to allow for a lateral movement of the panel the distance of the difference between the width of the aperture and the width of the clip. This movement or range of movement can be between an eighth of an inch to three quarters of an inch in many applications but could also be beyond that range depending on the application and remain within the inventive concept.

A version of the device can also include a base panel that is affixed to the vertical structure or hangers where the base panel is below the panel. The hanger can be any of: a corner assembly having at least two parallel rows of clips oriented about ninety degrees from each other; a joint assembly having at least two parallel rows of clips oriented substantially coplanar to each other; or a single row of clips.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wall panel system comprised of a panel, a frieze, a base and a first and second hanger;

a back side of the panel includes along both a left vertical edge and right vertical edge a plurality of apertures spaced apart vertically at a first period;

the left vertical edge is substantially parallel to the right vertical edge;

the apertures each have a predetermined horizontal first width;

a back side of the frieze has a third hanger along a top edge;

a back side of the base has a fourth hanger along a top edge;

a front face of the panel and a front face of the frieze and a front face of the base each have a decorative finish;

the first and second hanger each have a vertical edge that has a plurality of integral clips along a length of the first and second hanger;

the clips are spaced apart equal to the first period;

the clips each have a predetermined horizontal second width;

the first hanger and the second hanger are affixed to an existing vertical structure so that the first hanger and second hanger are substantially parallel;

the first and second hangers are positioned apart on the existing vertical structure so that each of the apertures are substantially centered over a corresponding clip of the plurality of integral clips;

the width of each aperture is greater than the width of the corresponding clip to allow for a lateral movement of the panel throughout a first range defined by a difference between the horizontal first width and the horizontal second width;

each aperture fits onto the corresponding clip and is capable of temporarily resting on a bend in the corresponding clip to support the panel for an alignment of the panel at any point in the first range of said lateral movement;

when properly aligned the aperture is fully seated into the corresponding clip and the fourth hanger on the frieze is affixed to both the first hanger and second hanger that prevents the panel from unseating off of the plurality of integral clips thereby immobilizing the panel onto the first and second hangers.

2. A wall panel system as in claim 1 further characterized in that a base panel is affixed to the vertical structure or to the first and second hangers by the fourth hanger where the base panel is below the panel.

3. A wall panel system as in claim 1 further characterized in that the first or second hanger can be any of:

a. a corner assembly having at least two parallel rows of clips oriented about ninety degrees from each other;

b. a joint assembly having at least two parallel rows of clips oriented substantially coplanar to each other;

c. a single row of clips.

4. A wall panel system as in claim 1 further characterized in that the first range is between an eighth inch and three quarters inch.

5. A wall panel system comprised of a panel, a frieze, a base and a first and second hanger;

a back side of the panel includes along both a left vertical edge and right vertical edge a plurality of apertures spaced apart vertically at a first period;

the left vertical edge is substantially parallel to the right vertical edge;

the apertures each have a predetermined horizontal first width;

a back side of the frieze has a third hanger along a top edge;

a back side of the base has a fourth hanger along a top edge;

a front face of the panel and a front face of the frieze and a front face of the base each have a decorative finish;

the first and second hanger each have a vertical edge that has a plurality of integral clips along a length of the first and second hanger;

the clips are spaced apart equal to the first period;

the clips each have a predetermined horizontal second width;

the first hanger and the second hanger are affixed to an existing vertical structure so that the first hanger and second hanger are substantially parallel;

the first and second hangers are positioned apart on the existing vertical structure so that each of the apertures are substantially centered over a corresponding clip of the plurality of integral clips;

the width of each aperture is greater than the width of the corresponding clip to allow for a lateral movement of the panel that is a first range defined by a difference between the horizontal first width and the horizontal second width;

each aperture fits onto the corresponding clip and is capable of temporarily resting on a bend in the corresponding clip to support the panel for an alignment of the panel at any point in the first range of said lateral movement;

when properly aligned the aperture is fully seated into the corresponding clip and the fourth hanger on the frieze is affixed to both the first hanger and second hanger that prevents the panel from unseating off of the plurality of integral clips thereby immobilizing the panel onto the first and second hangers;

a base panel is affixed to the vertical structure or hangers where the base panel is below the panel;

the hanger can be any of:

a. a corner assembly having at least two parallel rows of clips oriented about ninety degrees from each other;

b. a joint assembly having at least two parallel rows of clips oriented substantially coplanar to each other;

c. a single row of clips;

the first range is between an eighth inch and three quarters inch.

* * * * *